United States Patent [19]

Havey, III

[11] 4,176,431

[45] Dec. 4, 1979

[54] MULTI-ELEMENT CASKET

[76] Inventor: Ambrose S. Havey, III, 12 Grove Mews, Chappaqua, N.Y. 10514

[21] Appl. No.: 906,931

[22] Filed: May 18, 1978

Related U.S. Application Data

[63] Continuation-in-part of Ser. No. 847,403, Oct. 31, 1977, which is a continuation-in-part of Ser. No. 718,114, Aug. 27, 1976, Pat. No. 4,063,337.

[51] Int. Cl.[2] ..... A61G 17/00

[52] U.S. Cl. ..... 27/2; 27/4

[58] Field of Search ..... 27/2, 4, 3, 35; 229/6 R, 41 R

[56] References Cited

U.S. PATENT DOCUMENTS

| | | | |
|---|---|---|---|
| 3,782,619 | 1/1974 | Dittbenner | 27/35 |
| 4,063,337 | 12/1977 | Havey | 27/2 |
| 4,123,831 | 11/1978 | Covington | 27/4 X |

*Primary Examiner*—John D. Yasko

*Attorney, Agent, or Firm*—Handal & Sims

[57] ABSTRACT

An improved multi-element casket comprising a facade of an outer casket shell having a top and sidewalls is disclosed. A container bottom is configured and dimensioned to be disposed within the outer casket shell with the sidewalls of the outer casket shell extending around the container bottom. Support means is provided for supporting the container bottom within the outer casket shell. This support means comprises at least first and second mating support elements which interlock with each other and a planar support member positioned above them. Sheet means is configured, dimensioned and positioned to lie above the bottom of the container bottom and adjacent to sidewalls of the container bottom. Separator means, separate from the sheet means, is provided for supporting the sheet means in spaced relationship to the bottom of the container bottom.

19 Claims, 9 Drawing Figures

MULTI-ELEMENT CASKET

CROSS REFERENCE TO RELATED CASES

This application is a continuation-in-part of copending United States Application Ser. No. 847,403 Oct. 31, 1977 entitled Disposable Casket which is a continuation-in-part of Ser. No. 718,114, Sept. 27, 1976; U.S. Pat. No. 4,063,337 entitled Multi-Element Casket.

BACKGROUND OF THE INVENTION

Until relatively recently, the materials and practices connected with the burial of the dead have resisted the application of technology. Primarily, this has been a result of the solemnity and traditional conservativeness with which the funeral ceremony is viewed in the Western World. However, the traditional character of burial procedures and the expense connected with them have become an increasingly serious problem, whose solution grows more urgent every day.

For example, in the case of burials, large tracts of land are devoted to cemeteries, where the land might better be used for housing, industry or even agricultural purposes. For this reason, the cost of a burial place has risen sharply and cremation has become more popular. However, even cremations, which are relatively economical, are still quite expensive. This is because of the fact that the ceremony still requires a casket with all of its associated decorative appurtenances. These are all prepared by conventional techniques which require the expenditure of extensive handworkmanship and traditional materials. Most importantly, however, the casket is used only once and then it is destroyed by being burned with the body.

This intransigence to change has rendered the funeral ceremony expensive in comparison to other things that have become more economical over the years as a result of the efficiencies provided by the application of technology. Moreover, the high cost associated with funerals is far from unnoticed, and, in recent years, has become the object of mounting public concern. As a response to this concern, the multi-element casket with disposable insides and a permanent facade was developed. Such a device is shown in my earlier U.S. Pat. No. 4,063,337, entitled "Multi-element Casket," the disclosure of which is hereby incorporated by reference. In accordance with the disclosure of that patent, the casket comprises a container bottom which is configured and dimensioned to contain a suitable bedding material and the deceased. The container is covered by a facade in the form of an outer casket shell. This casket shell is placed over the container bottom and supported together with the container bottom on a bottom support member, thus giving the appearance of a conventional casket. When the deceased is to be cremated, the facade is removed and the container bottom and the bedding within it, together with the deceased is covered with a cover member and sent to the crematory. The removable casket shell is thus not destroyed and can be reused during another funeral ceremony.

In accordance with the practice in U.S. Pat. No. 4,063,337, an unused container bottom together with an unfilled mattress, other disposable elements and a pillow are shipped within a container, which also doubles as the top cover for covering the container bottom during shipment to the crematory. When it is desired to use the inventive casket, the mattress must be filled with a suitable filling material and then placed within the container bottom. However, this presents several problems. Primarily, it is difficult to fill the mattress in such a manner that it appears to be smooth and level. It was also a problem and expense to obtain appropiate filling material.

In accordance with the present invention, improved disposable components, and in particular an improved mattress, adapted for use in conjunction with a casket facade are provided. The new arrangement is convenient to use, economical and completely self-contained and thus sacrifices none of the advantages of my earlier multi-element casket.

SUMMARY OF THE INVENTION

In accordance with the present invention, a multi-element casket comprises an outer casket shell having a top and sidewalls. A container bottom is configured and dimensioned to be disposed within the outer casket shell with the sidewalls of the outer casket shell extending around the container bottom. Support means is provided for supporting the container bottom within the outer casket shell. Sheet means is configured, dimensioned and positioned to lie above the bottom of the container bottom and adjacent to side walls of the container bottom. Separator means, separate from the sheet means, is provided for supporting the sheet means in spaced relationship to the bottom of the container bottom.

DETAILED DESCRIPTION OF THE PREFERRED EMBODIMENTS

Figure 1:
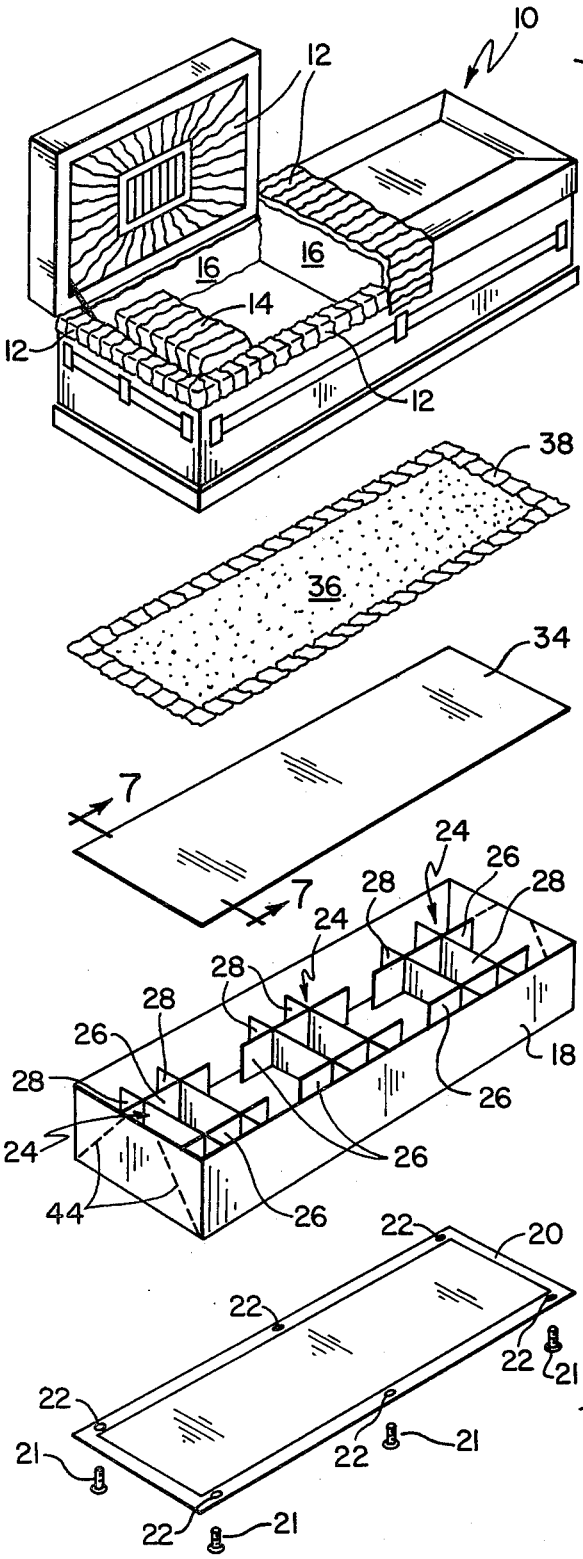
FIG. 1 is a view in exploded perspective of a multi-element casket constructed in accordance with the present invention.

Referring to FIG. 1, a multi-element casket constructed in accordance with the present invention is illustrated in exploded perspective. The casket comprises an outer casket shell 10 which serves as a facade and is provided with decorative lace 12 and a pillow 14. Crepe panels 16 are also provided. The crepe panels are formed of cardboard or any suitable support material to which a covering of crepe has been secured in order to provide the proper visual appearance.

Figure 2:
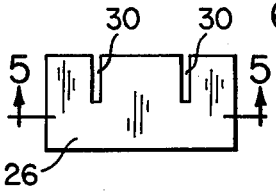
FIG. 2 is a plan view of a lengthwise support member used in the multi-element casket illustrated in FIG. 1.
Figure 3:
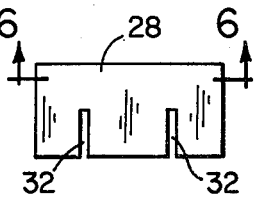
FIG. 3 is a plan view of a transverse support member used in the casket illustrated in FIG. 1.
Figure 4:
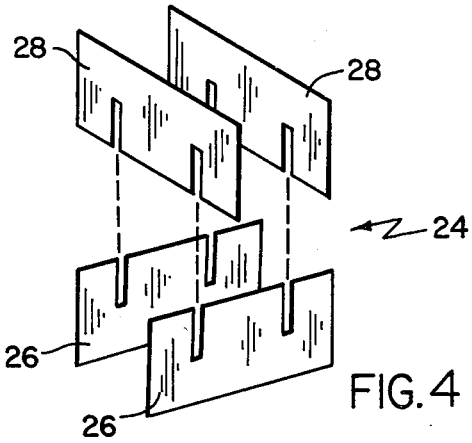
FIG. 4 is a view in exploded perspective illustrating the formation of support assemblies from the support members illustrated in FIGS. 2 and 3.

Casket shell 10 surrounds container bottom 18. Container bottom 18 and casket shell 10 both rest on base 20 which may be secured to outer casket shell 10 by screws 21 that pass through holes 22. Resting within container bottom 18 are a plurality of separators 24 which are made of lengthwise support elements 26 and transverse support elements 28. One of said lengthwise elements 26 is illustrated in FIG. 2. Lengthwise elements 26 include a pair of slots 30 which are cut to mate with slots 32 on transverse elements 28, as illustrated in FIG. 3. In accordance with the preferred embodiment of the invention, two lengthwise elements 26 interlock with two transverse elements 28 to form each separator 24, as is illustrated in exploded perspective in FIG. 4.

Resting over separators 24 in container bottom 18 is a planar support member 34. A crepe sheet 36 is, in turn, placed over planar member 34. Crepe sheet 36 includes a ruffled fringe 38 which enables the sheet to fit properly within bottom 18 by being compressed and ruffled inwardly to closely follow the inside contours of the container bottom.

Figure 5:
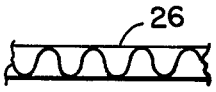
FIG. 5 is a view along lines 5—5 of FIG. 2.
Figure 6:
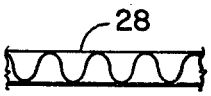
FIG. 6 is a view along lines 6—6 of FIG. 3.
Figure 7:
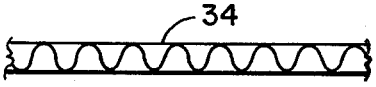
FIG. 7 is a view along lines 7—7 of FIG. 1.

In accordance with the embodiment illustrated in FIG. 1, the orientation of the corrugations in the cardboard of which separators 26 and 28 and planar support member 34 are made is indicated by the cross-sectional views in FIGS. 5–7. In accordance with this embodiment, separators provide maximum vertical strength for support of the deceased during use of casket while discontinuities in the lengthwise support provided by separators 24 are eliminated by the lengthwise direction of the corrugations in planar support member 34.

Thus, in accordance with the present invention, a casket is provided which has all the appearances of a conventional casket. However, when visiting at the home has been completed, the casket shell is removed and the container bottom together with separators 24, planar support member 34, crepe sheet 36, and the deceased are covered with a cover 40 (FIG. 8) and sent to the crematory. All the materials that come into contact with the deceased may also be put into the container 18 for cremation.

Figure 9:
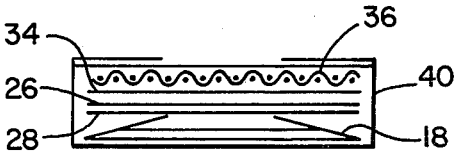
FIG. 9 is a cross-sectional view of a cover, such as that illustrated in FIG. 8, holding the various components of the multi-element casket during transportation and storage of said components.
Figure 8:
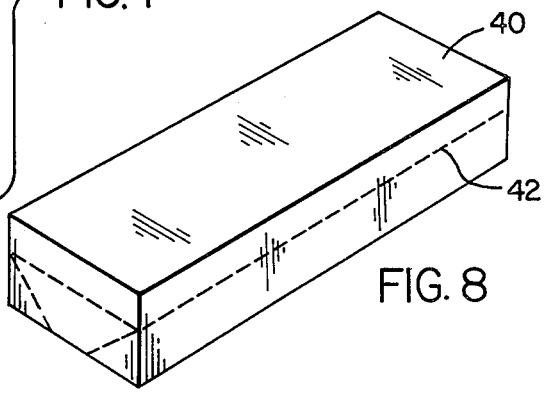
FIG. 8 is perspective view of a cover for the closing and transportation of the disposable portions of the inventive casket and the deceased after the termination of visitation, and which is particularly suited to be folded into a box for carrying the disposable portions of a multi-element casket during transportation and storage prior to use.

The present invention also provides the advantage of being able to store before use the disposable portions of the casket in a very convenient package. Specifically, cover 40, in a manner similar to that of the multi-element casket described in my U.S. Pat. No. 4,063,337, may be folded into a convenient box for storage and shipment of the casket bottom, lengthwise and transverse separators 26 and 28, planar support member 34, crepe sheet 36 and other disposable portions of the casket such as decorative lace 12, pillow 14 and panels 16 (FIG. 9). Folding is done along score lines 42 (FIG. 8). Likewise, container bottom 18 may be folded along score lines 44 to fit into cover 40. Container bottom 18 and the other disposable positions of the casket may then be stored and transported in cover 40 as illustrated in FIG. 9.

In contrast to the multi-element casket disclosed in my U.S. Pat. No. 4,063,377, there is no need for a separate element to keep container bottom 18 in a folded condition. Specifically, separators 24 and, in particular, transverse support elements 28 serve the function of keeping the container bottom open. If, because of the selection of the cardboard of which container bottom 18 is made, the container bottom tends to return to the folded position, it may be desirable to run the corrugations in transverse support elements 28 in a direction perpendicular to that illustrated in FIG. 6. In this case the strength of the support elements would be in the direction between the two lengthwise sides of container bottom 18 and will thus work well to keep the container bottom open. In this case, however, the vertical support function will be done by lengthwise support elements 26, and it is therefore desirable that the corrugations in planar support member 34 run in a direction perpendicular to that illustrated in FIG. 7. This is particularly the case where one wishes to use a very heavy cardboard to form container bottom 18.

As another alternative to the embodiment illustrated in FIG. 1, one may simply wish to add a second corrugated layer to the transverse support elements 28, in which the corrugations of the second layer run perpendicular to the corrugations in the first layer. Although this embodiment does involve the added expense of adding a second corrugated layer to half of the transverse support elements, it does have the effect of preserving the vertical strength provided by the transverse support members 28.

The inventive multi-element casket may be made of materials other than corrugated cardboard. Also, the corrugated cardboard of which it is made may be waterproofed by being coated with plastic or impregnated with wax. If desired, sheet 36 may be integral with and glued to support member 34. A pillow case alone may be shipped to the funeral home where it is filled prior to use. Likewise, as is discussed in my copending United States application Ser. No. 847,403 and entitled Disposable Casket, the disclosure of which is hereby incorporated by reference, the inventive casket may also be provided with deodorant, desiccant, or perfumery elements.

While a preferred embodiment of the invention has been illustrated, it is of course, understood that a number of variations will be obvious to those of ordinary skill in the art. Such variations are within the spirit and scope of the invention which is defined and limited only by the appended claims.

What is claimed is:

1. A multi-element casket, comprising:
   (a) an outer casket shell having a top and sidewalls;
   (b) a foldable container bottom, having sidewalls and a bottom, configured and dimensioned to be disposed within said outer casket shell with the sidewalls of said outer casket shell extending around said container bottom;
   (c) support means for supporting said container bottom within said outer casket shell;
   (d) sheet means configured, dimensioned and positioned to lie above the bottom of said container bottom and adjacent to sidewalls of said container bottom; and
   (e) separator means separate from said sheet means for supporting said sheet means in spaced relationship to the bottom of the said container bottom.

2. A multi-element casket as in claim 1, wherein said separator means, comprises:
   (a) spacer means positioned within said container bottom; and
   (b) a planar support member positioned within said container bottom and above said spacer means and supported by said spacer means.

3. A multi-element casket as in claim 2, wherein said spacer means is made of corrugated cardboard.

4. A multi-element casket as in claim 2, wherein said spacer means comprises at least a first support element and a mating support element which is interlocked with said first support element and is positioned at an angle with respect to said first support element to form said spacer means.

5. A multi-element casket as in claim 4, wherein said support elements have corrugations which extend substantially vertically from the bottom of said container bottom.

6. A multi-element casket as in claim 5, wherein said planar support member has corrugations which extend between the longer sidewalls of said container bottom.

7. A multi-element casket as in claim 5, wherein said mating support element extends between the longer sidewalls of said container bottom and said mating support element has at least two layers of corrugation, the corrugations in each layer extending substantially perpendicular to each other and one of said layers of said corrugations extending between the longer sidewalls of the container bottom.

8. A multi-element casket as in claim 5, wherein said mating support element extends between the longer sidewalls of said container bottom and has corrugations which extend between the longer sidewalls of said container bottom.

9. A multi-element casket as in claim 4, wherein said mating support element has corrugations which extend perpendicular to the bottom of said casket bottom.

10. A multi-element casket as in claim 4, wherein said container bottom and said separator means are made of corrugated cardboard which has been made waterproof.

11. A multi-element casket as in claim 10, wherein said container bottom and separator means are made waterproof by being coated with plastic or impreganted with wax.

12. A multi-element casket as in claim 10, further comprising deodorant, perfumery or desiccant means.

13. A multi-element casket as in claim 1, wherein said container bottom may be folded to a smaller size.

14. A multi-element casket as in claim 13, wherein said separator means, comprises:

(a) spacer means positioned within said container bottom; and (b) a planar support member positioned within said container bottom and above said spacer means and supported by said spacer means.

15. A multi-element casket as in claim 14, wherein said spacer means is made of corrugated cardboard.

16. A multi-element casket as in claim 15, wherein said spacer means comprises at least a first support element and a mating support element which interlocks with said first support element and is positioned substantially perpendicular to said first support element.

17. A multi-element casket as in claim 16, wherein said mating support element extends between the longer sidewalls of said container bottom and has corrugations which extend between the longer sidewalls of said container bottom.

18. A multi-element casket as in claim 1, wherein said sheet means is secured to a planar support member which is positioned over said separator means.

19. A compact package for storage and transportation of disposable materials for use in conjunction with a casket facade, comprising:

(a) a container box which is configured, dimensioned and scored to be unfolded to serve as a container bottom and folded back into a container box;

(b) separator means in a compressed condition and which is adapted to be expanded to a desired size contained within said folded container box; and (c) decorative lace means configured and dimensioned to overlie said separator means and cover the visible portions of said container box when said container bottom is unfolded and placed in a casket facade and said separator means is expanded and placed in said container box.

* * * * *